US005189477A

United States Patent [19]

Leys et al.

[11] Patent Number: 5,189,477

[45] Date of Patent: Feb. 23, 1993

[54] APPARATUS FOR THE PRODUCTION OF A COLOUR IMAGE

[75] Inventors: Paul H. Leys, Kontich; Jan A. Zwijsen, Wilrijk; Luc K. Van Aken, Kuringen, all of Belgium

[73] Assignee: AGFA-Gevaert N.V., Mortsel, Belgium

[21] Appl. No.: 798,005

[22] Filed: Nov. 26, 1991

[30] Foreign Application Priority Data

Dec. 17, 1990 [EP] European Pat. Off. ..... 90203347.1

[51] Int. Cl.[5] ..... G03G 15/01; G03G 15/00

[52] U.S. Cl. ..... 355/271; 355/327

[58] Field of Search ..... 355/271-277, 355/326, 327, 317; 346/157, 134, 136; 101/248; 430/126, 44

[56] References Cited

U.S. PATENT DOCUMENTS

| | | | |
|---|---|---|---|
| 3,862,848 | 1/1975 | Marley | 355/275 |
| 4,436,405 | 3/1984 | Kindt | 355/327 |
| 4,660,059 | 4/1987 | O'Brien | 346/157 |
| 5,081,507 | 1/1992 | Monkelbaan et al. | 355/327 X |

*Primary Examiner*—Joan H. Pendegrass
*Attorney, Agent, or Firm*—William J. Daniel

[57] ABSTRACT

An apparatus for forming a color image by transfer of at least one distinctively colored color image from a corresponding support therefor onto a single carrier support using a transfer cylinder for each color image for receiving on its periphery in a fixed location the image-carrying support and transport means carrying a register strip provided with register holes and attached to the leading end of the carrier support along a path tangential to the transfer cylinder periphery, the transfer cylinder including registering pins movable radially thereon between a retracted inoperative position and an operative projected position projecting outside the cylinder periphery for engagement with the register holes as the register strip arrives at the cylinder. After registration, the image-carrying support and carrier support are pressed together progressively along their length to transfer the image to the carrier support. The sequence is repeated at the transfer cylinder for each color image. The movement of the register pins is controlled timed relation to the transport of the register strip by control means, preferably a cam.

12 Claims, 4 Drawing Sheets

APPARATUS FOR THE PRODUCTION OF A COLOUR IMAGE

BACKGROUND OF THE INVENTION

1. Field of the invention.

The present invention relates to a process for production of a colour image by the successive transfer in registration onto a common carrier of distinct colour images each formed on a corresponding support and to a colour-image-forming apparatus of the type having a transfer device for transferring in registration distinct colour images which have been formed on individual first supports to a second support, i.e. a common carrier.

The invention concerns in particular colour proofing and colour printing.

2. Description of the prior art.

The process of transforming a multicolour original into an accurate and pleasing colour reproduction involves a series of complex manipulations: conversion of continuous tones into halftones; separation of multicolour images to individual films for the three primary colours and black; and adjustment of colour balance, size and composition. Prepress colour proofing systems make it possible to check the accuracy of these transformations without the high cost and time delay of on-press proofing.

One known colour proofing system is based on the production of distinct colour images by exposing precoloured films to corresponding colour separation films and then laying down all the colour images in register on one single support. Such a system is suited for the production of a few colour reproductions only, as all the different steps require manual intervention from a human operator.

The other extreme in colour reproduction is formed by printing presses in which a paper web is passed at high speed past different colour printing cylinders which are part of a rigid and accurate machine construction whereby the required precision in the image registering is obtained. In other types of printing machines, reference marks on the paper co-operate with sensing and steering mechanisms to obtain the correct registration of the (four) part images on the paper support which is afterwards cut into sheets.

SUMMARY OF THE INVENTION.

Objects of the invention

It is the object of the invention to provide a process for the production of colour images by successive transfer in registration of distinct colour images formed on corresponding supports to a common carrier, which allows the successive transfer in register of distinct colour images to take place in a more automatized way than so far known in colour proofing, while not yet requiring the use of complex machines as known in the art of colour printing.

According to the present invention, a process for the production of a colour image by successive transfer in registration of distinct colour images formed on respective supports to a common carrier comprises the following steps: (a) conveying two members, i.e. a common carrier and a support with a distinct colour image towards each other along converging paths, (b) allowing the position of at least the leading end of one of said two members conveyed towards each other to be adjustable while traveling through at least the end of its converging path, (c) registering the leading ends of the two members with respect to each other through co-operating register means engaging each other before the colour image of the support makes contact with the common carrier, (d) establishing a frictional contact between the leading ends of the support and of the common carrier, (e) disengaging the register means, (f) progressively displacing the frictional locus of contact between support and common carrier from their leading ends towards their trailing ends and transferring during such contact the colour image from support to carrier, (g) progressively separating the support and the common carrier other, and (h) repeating the above steps for every other support with a colour image thereby apply to the colour image thereof in registration with all other images already transferred to the common carrier.

The process according to the present invention is not limited to colour proofing but may be used for printing colour images as well. The images need not necessarily be colour reproductions of a colour original but may equally well be the final image obtained by superimposing two or more colour part-images, such as graphs, images of liquid or electric circuits, etc.

The distinct colour images may be obtained by the integral exposure of light-sensitive materials to an original colour image through appropriate colour separation filters in order to obtain corresponding colour separations. However, the distinct colour images may also be produced by the exposure of a light-sensitive material to an image generated on the screen of a CRT-tube, of a LCD panel, and the like.

Further, the distinct images may be produced by the scanningwise exposure of a light-sensitive material by means of a modulated laserbeam or a LED exposure head comprising a multiplicity of individually adressable light sources.

The term "colour images" encompasses images formed by liquid or dry pigments or toner compositions. For instance, the colour images may be electrophotographic images.

The distinct colour images on distinct supports may be produced in different ways.

According to one method, distinct colour images may be produced by electrostatically charging, image-wise exposing and then developing a photoconductive surface through an electrostatically attractable dry or liquid toner.

According to another method, distinct colour images may be produced by forming a persistent electroconductive image on a support, then electrostatically charging said support and tonerdeveloping it.

According to still another method, a distinct colour image may be formed by ion projection printing.

The distinct colour images may be formed on their corresponding support while this support is present in the machine for carrying out the transfer, i.e. on-line. For instance, the distinct colour images may be formed by appropriately charging, image-wise exposing and toner-developing a photoconductive cylinder surface. However, the formation of these colour images may also occur off-line, i.e. on separate supports mounted after the exposure in the transfer machine and then colour-developed, e.g. so-called master plates on which a persistent electroconductive image is formed in a known way and which are then mounted on a transfer cylinder for electrostatic charging, toner-development and image-transfer.

It has been found that the technique of the present invention of establishing registering contact between the different supports and a common carrier offers excellent results without having to use complex or rigid machine parts.

Registration is in fact effected in different phases. Firstly, the exact alignment of the leading ends of a support and the common carrier via the technique, known in itself, of providing co-operating register members engaging each other and, secondly, maintaining this aligment by establishing a frictional contact between the leading ends of both members so that the register means can then be disengaged. Finally, the frictional contact is progressively displaced from the leading towards the trailing end of the members.

Establishing a satisfactory frictional contact between a support and a common carrier can be realized by pressure means applying on the exposed side of a sandwich of both members, supported on a suitable base, a force which presses them together. Such pressure means can be formed by a pressure roller co-operating with a cylinder that functions as supporting base.

A sufficient frictional contact between both members may also be obtained by conveying the sandwich of both members along an arcuate path with a certain length.

In a suitable embodiment of the process of the invention, each of the supports carrying a distinct colour image is mounted on a distinct rotatable cylindrical surface and the common carrier is transported in succession past said cylindrical surfaces in angular contact therewith.

Other suitable embodiments of the process according to the invention are described below.

The process comprises registering the leading ends of a support bearing a distinct colour image and the common carrier by providing the leading end of one of said members with a registration strip with register holes and by attaching the other of said members with its leading end to a rotatable surface at a location adjacent to a place where register pins for co-operation with the holes of the registering strip are retractably mounted on said surface.

Supports with distinct colour images are mounted on distinct rotatable surfaces and the common carrier is transported past such surfaces in angular frictional contact therewith.

The superimposed distinct colour images may be transferred as a unit a second time, viz. from the common carrier to a final support and then fixed thereon.

The present invention also includes an apparatus for registering a first support bearing a colour image with a carrier onto which such toner image has to be transferred.

According to the invention, a colour-image-forming apparatus of the type having a transfer device for transferring in registration distinct colour images formed on corresponding supports onto a common carrier, comprises first means in the form of co-operating registering elements for aligning the leading end of a support and that of the common carrier, and second means for progressively bringing such support into rolling frictional contact with the common carrier thereby extending the area of registration progressively along the complete surface of the supports.

According to an embodiment of the invention, the second means for bringing two such members into rolling contact are pressure roller means.

According to a further embodiment, the co-operating registering elements are register pins co-operating with register holes in a register strip. The register pins may be retractably mounted in rotatable transfer cylinders arranged for attachment of one of both members thereto and the registering holes may be provided in a register strip arranged for attachment to the leading end of the other of said both members and for transport of said members along the cylinders bearing the one member.

The register strip may be attached to endless transport means for transport of one of said members past the other one, the latter being attached to a transfer cylinder. The register pins may be retractably mounted in such transfer cylinder and may be controlled to progressively protrude from the peripheral surface of the cylinder thereby seeking the holes of the register strip and smoothly entering into engagement therewith, and suddenly being withdrawn after termination of their function.

The endless transport means for the register strips may be two parallel endless chains between which the register strip is supported for limited adjustments of its lateral and angular position.

A suitable embodiment of a registering strip is one with a circular register hole near one end, and an elongate register hole near the other end.

BRIEF DESCRIPTION OF THE DRAWINGS

The present invention will be described hereinafter by way of example with reference to the accompanying drawings wherein.

DETAILED DESCRIPTION OF THE INVENTION

Figure 1:
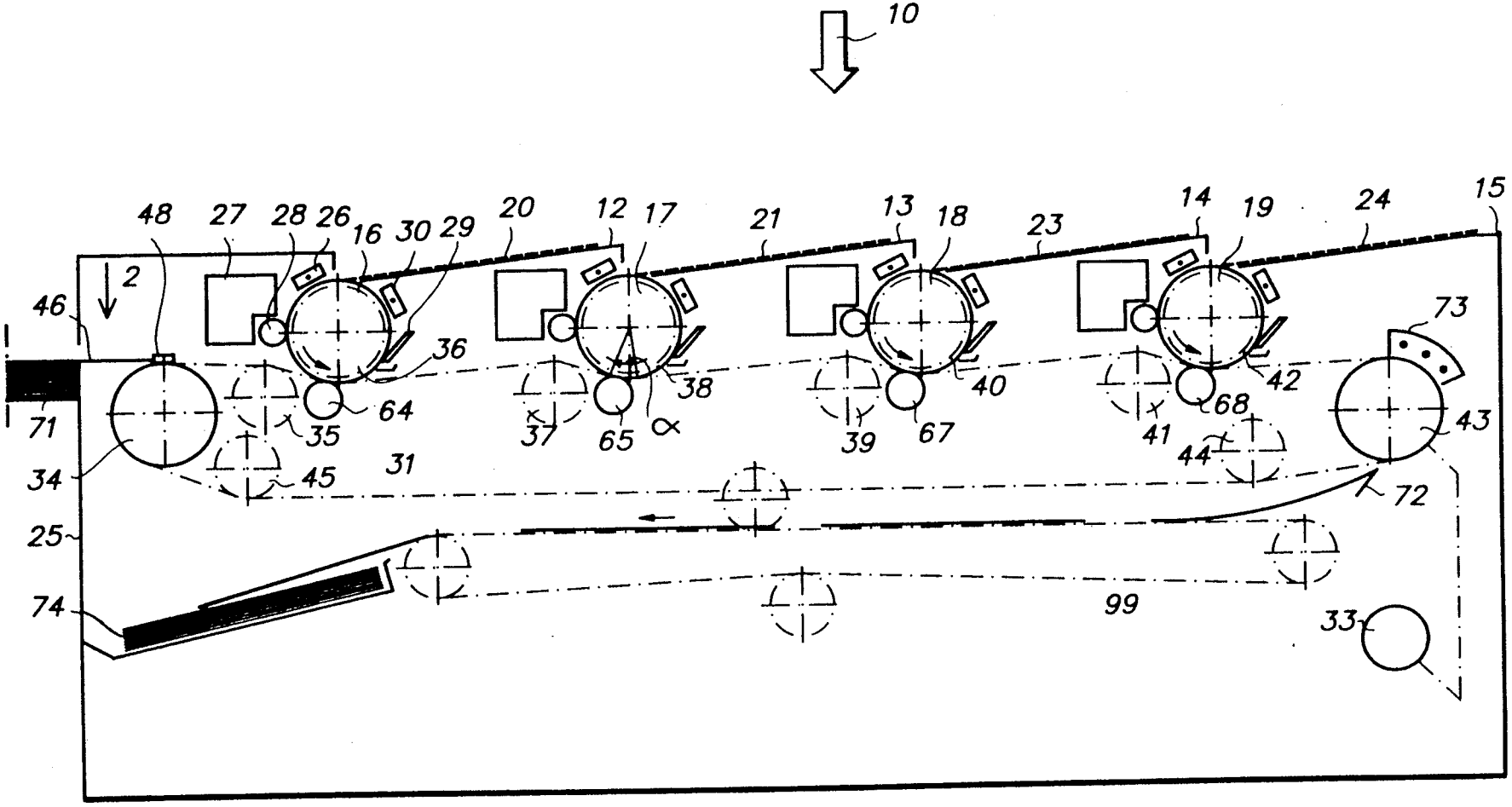
FIG. 1 is a diagrammatic illustration in side elevation of one embodiment of an apparatus for carrying out the process according to the invention.

FIG. 1 illustrates in a diagrammatic way one embodiment of an apparatus for carrying out the successive transfers in register of different colour images formed on different first supports to a second support.

The apparatus generally designated by the numeral 10 is mounted in a housing 25.

The top wall of the apparatus has four slightly slanting platforms 12, 13, 14 and 15 whereupon first supports 20, 21, 23 and 24 may be placed to be advanced through corresponding inlet openings towards transfer cylinders 16, 17, 18 and 19 arranged for attachment of said supports to their periphery. The supports are shown in broken lines and will in this example receive an electroconductive pattern on their upper surface.

Around each cylinder the following stations are placed in angularly spaced relationship, with the designations shown only for cylinder 16 associated with the first support 20: a corona charging station 26 for producing an electrostatic charge image on a first support 20 delivered to the surface of cylinder 16, a toner developing station 27 with a developing sleeve 28 in the form of a so-called magnetic brush for toner developing the charged support that moves in front of the sleeve, cleaning means 29 for removing residual toner that remains adhering to the support after toner transfer, and an A.C. corona station 30 for electrical neutralization of the support 20.

Furthermore, the apparatus comprises endless transport means in the form of two parallelly spaced endless chains 31 and 32 that run over a plurality of pairs of sprocket wheels 34, 35, 36, 37, 38, 39, 40, 41, 42, 43 and 45. Sprocket wheel pairs 36, 38, 40 and 42 are fitted to the lateral ends of cylinders 16 to 19 and are shown in broken lines.

Sprocket wheels 35, 37, 39 and 41 are located so that they cause an angular wrapping of the chains around the adjacent sprockets 36, 38, 40 and 42 over an angle "alpha" indicated for cylinder 17.

Motor means 33 ensure driving of the chains whereby the cylinders 16 to 19 are correspondingly rotated.

Figure 2:
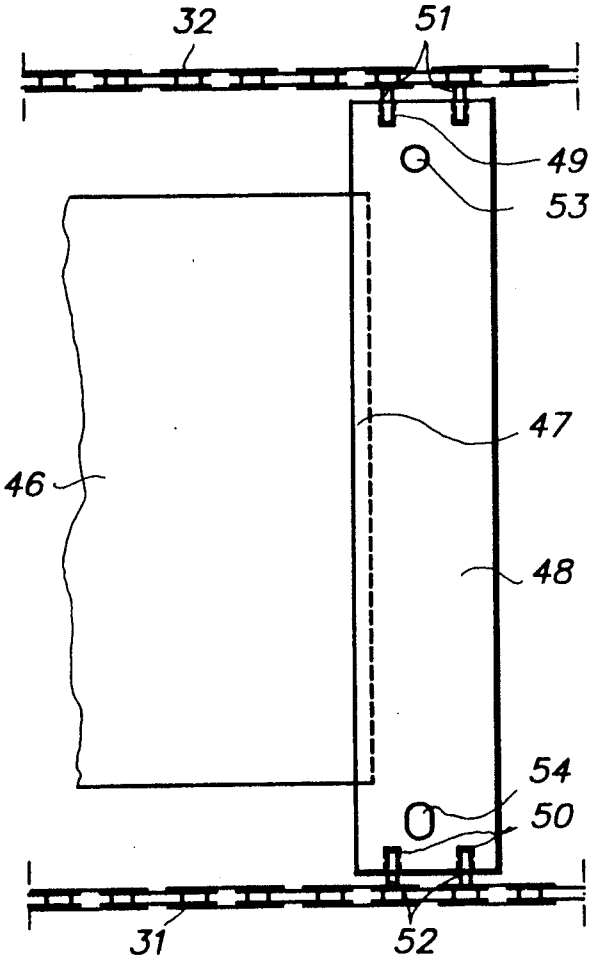
FIG. 2 is a plan fragmentary view taken in the direction of the arrow 2 of FIG. 1 showing the manner of supporting of the leading end of a common carrier through a register strip.

FIG. 2 illustrates the transport of a second support functioning as a common carrier to receive the toner images from the first supports.

A second support 46, serving as the common receptor support and seen at the left side of FIG. 1, is fitted with its leading end 47 to a register strip 48 (see FIG. 2) in the form of a rectangular metal bar. Clamping of the support to the strip is not shown, but may occur in any suitable way known in the art. Suitable clamping mechanisms may include a plurality of register pins on the bar co-operating with corresponding register holes in the leading end of the support, a simple clamping plate for clamping the leading edge of the support to the bar, etc. Perfect registration of the support is not required here. It is important that the position of the leading end of the support relative to the register strip is not altered during transport past the different stations.

Bar 48 at its opposed ends has pairs of horizontal bores 49 and 50 in which pins 51 and 52 fit with a large clearance. The pins are in fact extensions of two consecutive pivotation pins of the chain links of endless chains 31, 32. The described mounting of the register strip achieves a reliable transport of the strip and of the support trailed therebehind, while yet allowing limited angular and translational adjustments of the strip as it is being brought into register with the successive transfer cylinders of the apparatus. This registering is based on the co-operation of two register holes 53 and 54 in the strip with two corresponding register pins 56 in each transfer cylinder.

Figure 3:
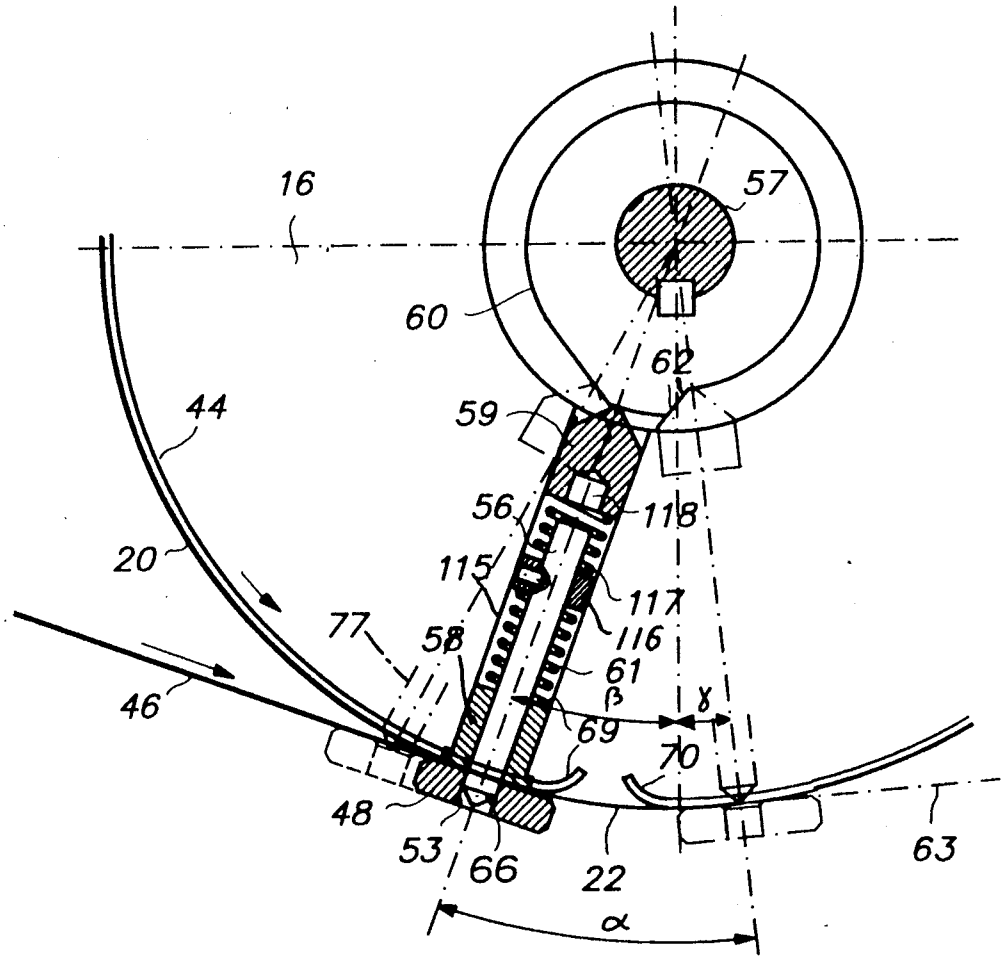
FIG. 3 is a diagrammatic sectional view of a cylinder with retractable registering pins.

FIG. 3 illustrates a registering pin 56 being a part of a diagrammatic cross-sectional view of a flange of cylinder 16 as an example. The cylinder, which is actually a hollow drum formed by a cylindrical mantle and two end flanges, is provided with roller bearings so that it can freely rotate about a stationary shaft 57 by the driving force imparted by the chains to the sprocket wheels fitted to the cylinder as described above.

Inside the cylinder, there are two register pins. Each register pin is a rod-like member or plunger 56, having a conically shaped outer end, which is axially slideable in a guide 58 fitted into a radial bore 115 in each flange of the cylinder. At the inside end of the bore 115, there is a cam follower 59 in sliding contact with a stationary cam 60 locked to the shaft 57. A helical spring 61 biases the pin 56 radially inwardly in the direction of the cam through of a collar 116 fitted to the pin.

The axial displacement of the cam follower 59 is yieldable transmitted to the pin by a compression spring 117 between the follower and the collar 116, as spring 117 is stronger than spring 61. If for one reason or another, the movement of the pin out of the cylinder is impossible, e.g. by abutment on the register strip instead of engaging a register hole, the cam follower 59 simply compresses spring 117 so that machine damage is prevented. A bore 118 in the cam follower allows the follower to telescope over the end of a blocked pin.

The length of the register pin 56 is such that as the follower 59 rides on top of the cam, as shown in the figure, the conical tip 66 of the pin protrudes from the peripheral surface 44 of the cylinder and engages a hole 53 resp. 54 in the register strip 48 conveyed by the chains in timed relationship along a path converging with that of each support, e.g. the support 20, to a locus where the register holes and pins almost coincide. Exact registering of the leading ends of supports 20 and 46 is based on the engagement of the register pins with the holes, facilitated by the conical ends of the pins.

A further point worth mentioning is that one register hole, viz. 53 has a circular opening, whereas the other one, viz. 54 has a laterally elongated opening with a width corresponding to the diameter of opening 53. This configuration allows some slight deviation of the distance between the centers of the register holes so that a tension-free engagement of the holes with the pins is obtained at any time.

Timing of cam 60 is such that the register pins are almost fully extended at the moment of tangential contact of register strip 48 with peripheral surface 44 of cylinder 16, viz. at the angle "beta" with respect to the vertical in of FIG. 3. Furthermore, timing of cam 60 is such that the pins are retracted very quickly over an angle "gamma" after the supports have moved through the angle "beta". To that end, flank 62 of the cam has an angle of nearly 45°, so that at the end of the angle "alpha", which is the angle of wrap of the support 46 around the cylinder, the pins are completely withdrawn as is shown in broken lines. Support 46 follows a straight path, indicated by the broken line 63 up to the next transfer cylinder. The position of the register pin at the moment it starts to "seek" the hole of the register strip is shown in broken lines 77.

Co-operation of register strip 48 with the register pins of transfer cylinders 17, 18 and 19 is similar to that described hereinbefore for cylinder 16.

Supporting the part of support 46 behind the leading end 47 is not shown in FIGS. 1 and 2. This part may be supported by small bars, rods, wires or the like extending between the chains at regular intervals. The trailing end of support 46 may be held under control by any known means, provided that such end and the rest of the support downstream of leading end 47 is capable of undergoing slight lateral displacements as the locus of frictional contact between the support and the common carrier is being displaced from the leading towards the trailing end.

Furthermore, the apparatus comprises two parallel endless chains 99 (see FIG. 1) with interconnecting carrier means for receiving the second support after it has passed beyond the last of the distinct transfer cylinders.

The apparatus finally comprises guide rollers 64, 65, 67 and 68, (see FIG. 1) which are bodily displaceable idler rollers, the position of which is controlled by other cam means (not shown) mounted on the transfer cylinders, so that such rollers are remote from the transfer cylinders to let pass the registering strips 48 unobstructedly, and then to apply the second support 46 in good angular relationship to a first support on each transfer cylinder as such registering strip has passed the roller whereby appropriate frictional engagement between both supports is obtained.

Rollers 64 to 68 have slightly thickened end parts (not shown) which bear on the corresponding cylinders 16 to 19, thus leaving a gap between the central part of the pressure rollers and the cylinders which is almost equal to the thickness of the second supports, thereby to apply almost no pressure to said supports.

It is thus clear that the required friction between two cooperating supports is mainly a consequence of the geometry of the device which causes a free receptor support to follow a curved path about the image-carrying support fitted to the transfer cylinder, so that in this way a sufficient relative friction is obtained between both supports which maintains fixed the relative position of the supports. It will be understood that a satisfactory friction may be obtained also by the use of (a) pressure roller(s), and to that end the rollers 64 to 64 may occasionally be arranged, e.g. by a reduction of their gap, to operate as pressure rollers. Suchlike pressure roller arrangement may be suitable in the case of a limited angle of wrap of a support 46 about a transfer cylinder.

FIG. 3 also shows diagrammatically the attachment of a first support to the peripheral surface 22 of a transfer cylinder. This has been exemplified by the leading and trailing ends 69 and 70 of support 20 being inwardly deflected and held by jaws or clamps, not shown. In practice, such ends may be perforated according to a known standard to co-operate not only with register pins on the transfer cylinders, but also with register pins on the exposure apparatus for carrying out the imagewise exposure of the first supports.

Furthermore, the leading end 69 of support 20 is shown in FIG. 3 as being clamped to transfer cylinder 16 at a position upstream of the register pins 56. It is clear that such leading end may also coincide with or be downstream of such pins.

The apparatus also comprises a large number of other means such as high-voltage generators, means for controlling the supply of a high-voltage to a corona station, speed control means, toner monitoring units, etc. All these means are known in the art and their detailed description is not required for understanding the operation of the present embodiment of an apparatus for carrying out the process according to the invention.

Operation of the apparatus

Four photoconductor supports 20, 21, 23 and 24 are successively exposed to a colour original under appropriate conditions of illumination and time to obtain a blue, a red, a green and a black-and-white separation of an original colour image. Exposure occurs on a camera provided with registering means so that afterwards the separation images of the original image can be brought into register.

In this specification no detailed description of a particular material suited for electrostatic image formation is given, but a good example of the composition of such material and of its photopolymerizable layer in particular can be found in our co-pending EP Application 89 202664.2 filed on Oct. 23, 1989 entitled: "A xeroprinting process", wherein so-called master plates are described.

The four supports with the colour separations in the form of an electroconductive pattern are then placed on the corresponding platforms 12 to 15 with their image side facing upwardly and slid forward until their leading end becomes gripped by appropriate clamping means in the transfer cylinders 16 to 19.

A second support 46, e.g. in the form of a sheet of plain paper, is taken by a feeding mechanism from a supply stack 71 of paper sheets and fed towards a registering strip 48 that at that moment takes a position as is shown in FIG. 1 and to which the leading end of the sheet is attached.

Then the transport of the chain mechanism of the apparatus starts. Corona stations 26 and 30 and toner developing station 27 are activated so that the latent conductivity image on support 20 is first of all electrostatically charged and then developed in a complementary colour, e.g. yellow for the blue colour separation.

As the registering strip 48 dragging the paper sheet approaches cylinder 16, the registering pins 56 have been projected for engagement with the corresponding holes of registering strip 48, so that this strip and thus the leading end of the paper sheet becomes accurately aligned with the transfer cylinder and thus also with the developed support attached thereto.

Immediately after passing of the register strip beyond the pressure roller 64, the latter is displaced towards cylinder 16. Since the roller 64 is connected to a D.C. high potential of a polarity opposite to that to which the support has been charged, the toner image thereof is transferred to the paper sheet as the latter moves in angular contact with the support.

Correct registration between the support and the paper sheet is not lost by retracting the register pins from the register strip as the latter has reached the position shown in broken lines in FIG. 3. On the contrary, the angular frictional contact of the paper sheet with the support maintains the correct position of the paper sheet with respect to the support on the cylinder, during the rolling contact of both members.

Paper sheet 46 which now bears the first toner image is advanced to cylinder 17. The length of the path is defined so that the sheet reaches the contact zone with cylinder 17, after this cylinder has just done one revolution in synchronism with the cylinder 16.

The corona stations and the developing station of cylinder 17 are activated so that the second support 21 is now developed and the transfer of the cyan image can start after the registering strip pulling the paper sheet has reached the register pins of the second transfer cylinder. The process as described above for the first cylinder is now repeated and leads to the deposition of the second toner image on the paper sheet in register with the first image.

The paper sheet continues its way towards the third transfer cylinder 18, the developing mechanism of which is actuated to produce a magenta toner image on support 23 for transfer to the paper sheet at the right moment.

The transfer operation is repeated a last time for the transfer cylinder 19, whose support 24 bears a black-and-white selection of the colour original.

The paper sheet is then conveyed past a fixing station 73 for letting the toner images melt on the paper support, whereby the image is fixed.

The paper sheet bearing the four superimposed colour separations is detached from the register strip by a mechanism 72 conducting the sheet to carrier means extending between the parallel chains 63.

The finished print is laid down in a collector tray 74.

The apparatus described hereinbefore is suited for colour proofing wherein one or more paper sheets of the desired paper quality is (are) printed in the apparatus.

The apparatus is also suited for colour printing. In that case the paper sheets may be taken from supply 71 at a rate related to the rate of rotation of the transfer cylinders. So, while a given sheet receives its fourth toner separation image at station 19, the next sheet receives its third toner image at station 18, the still next one its second toner image at 17 and still a next one its first toner image at station 16.

Figure 4:
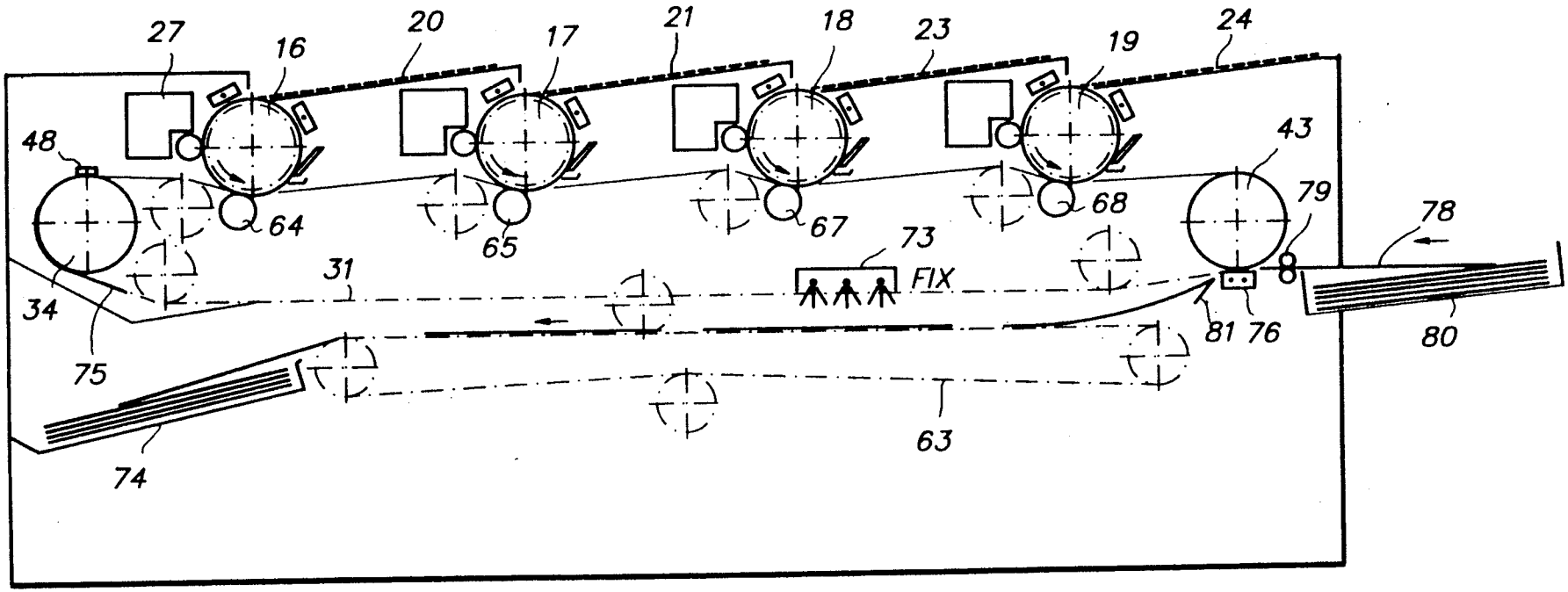
FIG. 4 is a diagrammatic illustration of a modified embodiment of the apparatus according to FIG. 1.

FIG. 4 illustrates an embodiment of an apparatus for carrying out the process of the invention wherein the final image is produced through an intermediate carrier. The embodiment of FIG. 4 corresponds to a large extent to that of FIG. 1, and hence parts that are common with FIG. 1 receive the same numerals.

Intermediate transfer operates as follows. A register strip 48 fitted between parallel chains 31 drags a flexible carrier 75. Carrier 75 is shown by a bold line in the figure. The distinct toner images are transferred from the respective supports 20 through 24 to said carrier as described hereinbefore for the transfer to the paper support, so that downstream of the cylinders the four separation images are in superimposed register on the intermediate carrier.

The apparatus comprises a transfer corona station 76 for transferring the complete toner image from the intermediate carrier 75 to a paper sheet 78 fed in timed relation by feed rollers 79 from a stack of sheets 80 towards sheet 75.

Separating means 81 separates the final support bearing the toner colour image from the intermediate carrier and conveys it towards a transport belt 63 that passes the support in front of a fixing station 73 causing the fixing of the toner image to the support.

The finished print is laid off in a tray 74.

In the apparatus described hereinbefore, the supports with the toner separation images remained bodily stationary, whereas the carrier receiving the transferred toner images moved successively past the distinct supports. It is possible to reverse these relative motions and this is described hereinafter with reference to FIG. 5 which diagrammatically represents another embodiment of an apparatus for carrying out a process within the scope of the invention.

Figure 5:
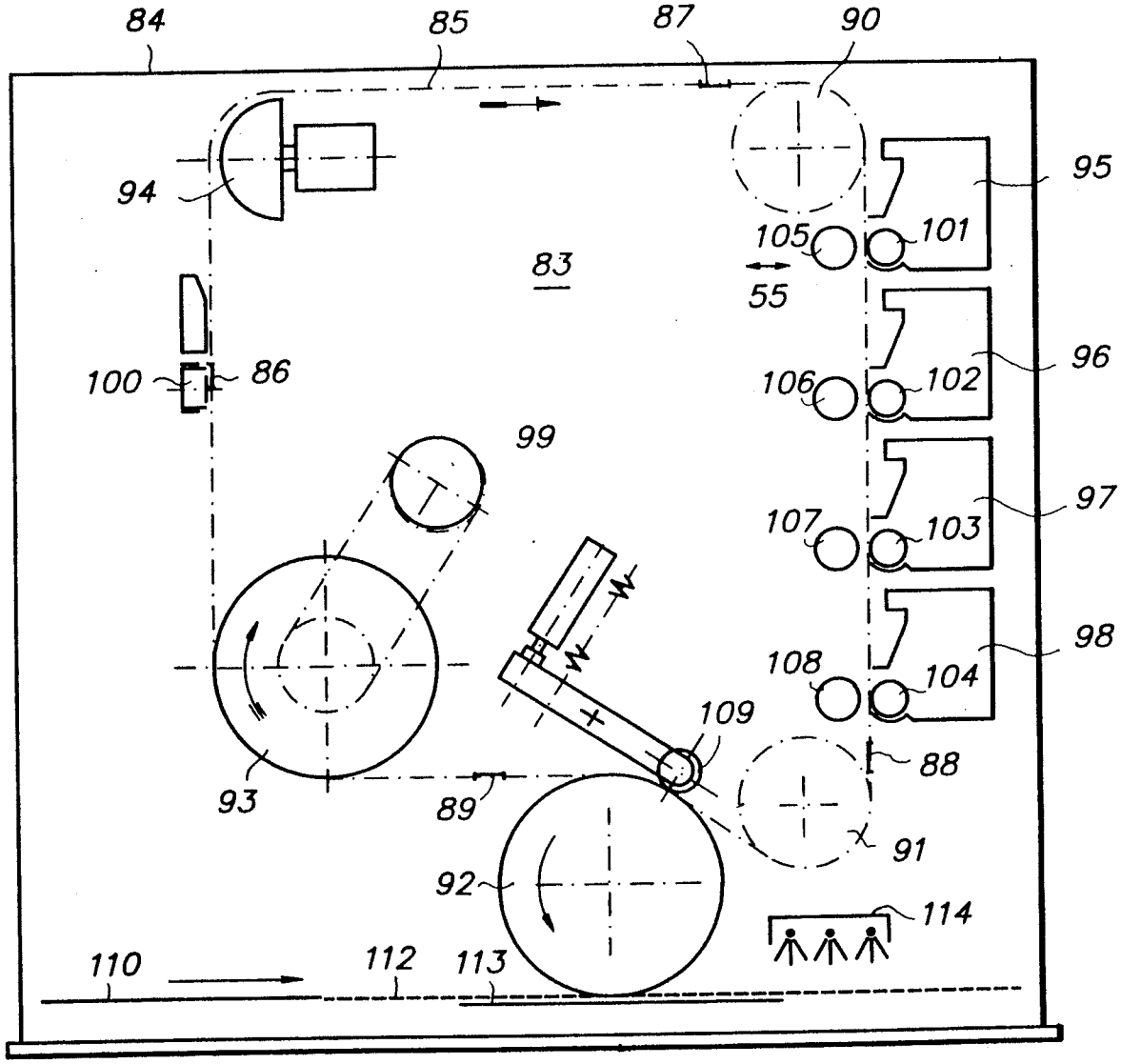
FIG. 5 is a diagrammatic illustration of another embodiment of an apparatus for carrying out the process according to the invention.

In FIG. 5, apparatus 83 is mounted within a housing 84 where sprocket wheels and rollers for conveying two parallel chains 85 (only one being shown) along an endless path are provided. Four register strips 86 to 89 are mounted between the chains at equal intervals. Fixation of the strips to the chains is yieldable, for instance in a way as described hereinbefore with reference to FIG. 2.

The chain path is defined by sprocket wheels 90 and 91, an electrically conductive transfer cylinder 92 being electrically insulated from the apparatus, a sprocket 93 driven by a motor 99 and a chain tensioner 94.

Between the driving sprocket 93 and the chain tensioner 94 a corona charging station 100 for electrostatically charging a support that passes in front of it is mounted.

Along the stretch of the chains between sprockets 90 and 91 four toner development stations 95 to 98 for applying a toner of the appropriate colour to a support through rotatable developing sleeves 101 to 104 (so-called magnetic brushes) are provided. The stations are located so that the distance between the developing sleeves and the charge bearing surface of a support is too large to obtain any toner transfer. However, in front of the developing sleeves, backing rollers 105 to 108 that are individually displaceable as indicated by the arrow 55 are provided, thereby to reduce the gap between a support and its corresponding developing sleeve to approximately 0.3 to 0.7 mm, whereby the development can take place.

The apparatus operates as follows.

The operator makes four colour separation selections from a colour original on four supports, as described hereinbefore, and attaches these four supports to the four register strips 86 to 89 by advancing the endless transport mechanism every time by ¼th of its length.

Then the development of the support starts.

As soon as the first support, e.g. the blue separation pulled by the register strip 87, has passed the sprocket wheels 90, development station 95 is caused to develop (by a yellow toner) the support by actuating backing roller 105 pressing the path of the support towards developing sleeve 101. Roller 105 is reset when the support has left station 95. The second support pulled by registering strip 86 is developed in the appropriate colour by actuating the backing roller 106 causing development station 96 to become operative.

In the meantime, the first support has reached transfer cylinder 92. After registration of the register strip of this support through corresponding register pins on cylinder 92, roller 109 is displaced towards cylinder 92 to bring the support in firm frictional contact with the periphery of said cylinder. A voltage applied to the cylinder creates an electrostatic field producing the progressive transfer of the toner image from the support to the cylinder.

The third support is developed in station 97, the toner image of the second support is transferred to cylinder 92 in register with the first toner image and so on until finally four superimposed toner images have been applied in exact register to transfer cylinder 92.

Then a final support, e.g. a paper sheet 110, is transported along path 112, indicated in broken lines, in tangential contact with cylinder 92. A high voltage difference is established between the cylinder 92 and a conductive backing plate 113 in contact with the backside of the paper sheet causing the transfer of the complete toner image to the paper support. A fixing station 114 fixes the image to the paper support.

The present invention is not limited to the embodiments described hereinbefore.

The endless chains may be replaced by other known transport means, e.g. timing belts.

The register pins need not necessarily be mounted in the transfer cylinder bearing a support with a colour image to be transferred, but can also be mounted in an opposed reversely rotating cylinder or cylinder segment mounted close to the transfer cylinder and rotationally coupled therewith to rotate in synchronism. A support with a colour image fixed to the transfer cylinder and the common carrier are conveyed towards the cylinder in the gap between said cylinder and the opposed registering cylinder. At a certain moment the pins of the registering cylinder engage the register strip of the common carrier and correctly align the latter with the register cylinder, and in consequence also with the transfer cylinder. Further rotation of the transfer cylinder causes the common carrier to become wrapped around this cylinder over a certain angle, so that registry with the support is maintained while image transfer proceeds.

If the image-wise exposure of a colour separation occurs on a support while the latter is on the transfer cylinder in the image transferring apparatus as described in the introduction of the specification, the means carrying out such exposure, e.g. a laser beam arrangement or a LED exposure head, may be controlled in such a way that the exposure of the image occurs in timed relation to the position taken by the support. So, the position of the image on the support as well as the corresponding position of the transferred image on the common carrier can be controlled very accurately.

Each distinct toner image that is transferred to the common carrier may be subjected to an intermediate fixation before the next toner image is transferred to the previous one. Such fixation can overcome two possible causes for a less satisfactory image transfer. Firstly, a toner image transferred to the common carrier produces a counter-voltage that may influence the transfer of a next toner image and secondly, a first support with a developed toner image may pick up a certain amount of toner transferred to the common carrier from a previous support. It has been found that an intermediate fixation through energy selectively absorbed by the toner and not by its support, gives excellent results. This intermediate fixation step is disclosed in our co-pending EPO application entitled: "Colour electrophotographic apparatus and method comprising intermediate fixing steps", filed on even day herewith.

The transport of a common carrier past the distinct supports bearing the corresponding colour separation images, as illustrated e.g. in FIG. 1, need not necessarily occur by mechanical means that provide nearly a perfect synchronism between the motions and the relative positions of such members. Thus, transfer drums 16, 17, 18, 19 and transport chain 31 may be driven independently from each other provided that control means is provided for adjusting the relative position of sheet 46 with respect to supports 20, 21, 23 and 24 such that at the moment the final registering by means of the co-operating register strip and pins is going to occur, a relative position is obtained that is within prescribed tolerances which allow such final accurate registration.

We claim:

1. An image-forming apparatus of the type having a transfer device for transferring at least one distinctive image from a corresponding support carrying the same to a single carrier support, which apparatus comprises co-operating registering elements for bringing into alignment the leading end of each such image-carrying support with the leading end of said carrier support, said registering elements comprising a register strip provided with register holes and adapted for attachment to the leading end of said carrier support and co-operating registering pins for registering engagement with said holes, a rotatable transfer cylinder for each such image support in which said registering pins are mounted for movement along an axis extending generally radially of said cylinder between a retracted position fully contained within the cylinder periphery and a projected registering position with the outer ends thereof protruding outside the cylinder periphery, each such transfer cylinder being adapted to carry the corresponding image-carrying support on its periphery with the leading end of support engaged thereon in a predetermined peripheral position, feeding means for advancing said register strip and the carrier support attached thereto into proximity with the periphery of each such transfer cylinder to bring the register holes on said strip into registration with the register pins in their projected position and thus bring the respective leading ends of the image-carrying support and carrier support into registration, pressure means for urging the thus-registered image-carrying support and carrier support into intimate frictional contact progressively along their length to transfer the image from its support to the carrier support, and control means for controlling the retraction and projection of said register pins in substantially timed relation to the advance of said register strip and carrier support to move said pins into their projected position at least coincidental with the arrival of the register strip at each transfer cylinder.

2. The apparatus of claim 1 wherein said image is distinctively colored and there are a plurality of such distinctively colored images each on its own support for transfer onto a common carrier support, and a corresponding plurality of said transfer cylinders are arranged in succession in a row, and said feeding means advances said register strip with the carrier support attached thereto along a path which is generally tangential to the peripheries of said transfer cylinders to bring the register strip and carrier into successive registration with the image-carrying supports on the transfer cylinders.

3. The apparatus of claim 1 wherein said feeding means includes guide means for guiding said register strip and carrier strip attached thereto into contact with a predetermined arcuate angle of the transfer cylinder periphery and said pressure means is disposed along the cylinder periphery within such arcuate angle.

4. The apparatus of claim 3 wherein said register pins are normally in retracted position and said control means causes the register pins after their projection to return to their retracted position while the register strip remains in contact with the transfer cylinder periphery.

5. The apparatus of claim 4 wherein the register pins are caused to return to their retracted position at a more rapid rate than the movement of such pins to their projected position.

6. The apparatus of claim 4 including spring biasing means associated with said register pins to bias the same normally to their retracted position and said control means comprises means operative to displace said pins axially outwardly against such bias to their projected position.

7. The apparatus of claim 6 wherein said control means comprises cam means disposed in fixed position relative to the rotation of said transfer cylinders.

8. The apparatus of claim 6 wherein said register pins have inner ends separated from said cam means and compression spring means are interposed between said cam means and the inner ends of said register pins, said compression spring having a spring constant exceeding that of said spring biasing means and permitting said pins to remain in retracted position in the event the pins are forcibly prevented from moving to their projected position due to accidental non-registration between the register strip holes and the register pins.

9. The apparatus of claim 1 wherein said feeding means comprises two endless transport means arranged in parallel and said register strip is supported between said transport means.

10. The apparatus of claim 9 wherein said register strip has at least one end thereof connected to the transport means for limited movement relative to the transport means to permit such strip end to make limited adjustment of the position of its holes to facilitate registering engagement of the register pins therein.

11. The apparatus of claim 9 wherein said endless transport means are endless chains.

12. The apparatus of claim 1 wherein said register pins have outer ends which are generally conical shaped to facilitate registering engagement with the register holes of the register strips.

* * * * *